US007762266B2

(12) United States Patent
Strasheim

(10) Patent No.: US 7,762,266 B2
(45) Date of Patent: Jul. 27, 2010

(54) MULTIPURPOSE CIGAR TOOL

(75) Inventor: Steven Strasheim, Lincoln, NE (US)

(73) Assignee: Effective Accessories, Inc., Lincoln, NE (US)

( * ) Notice: Subject to any disclaimer, the term of this patent is extended or adjusted under 35 U.S.C. 154(b) by 490 days.

(21) Appl. No.: 11/721,071

(22) PCT Filed: Dec. 22, 2005

(86) PCT No.: PCT/US2005/046456

§ 371 (c)(1),
(2), (4) Date: Jun. 7, 2007

(87) PCT Pub. No.: WO2006/071698

PCT Pub. Date: Jul. 6, 2006

(65) Prior Publication Data

US 2009/0183742 A1 Jul. 23, 2009

Related U.S. Application Data

(60) Provisional application No. 60/639,902, filed on Dec. 29, 2004.

(51) Int. Cl.
*A24F 3/02* (2006.01)

(52) U.S. Cl. ..... 131/184.1; 131/187

(58) Field of Classification Search ..... 131/184.1, 131/187, 190, 178
See application file for complete search history.

(56) References Cited

U.S. PATENT DOCUMENTS

| | | | | |
|---|---|---|---|---|
| 1,386,494 | A * | 8/1921 | Haney | 131/258 |
| 6,006,432 | A * | 12/1999 | Cachot | 30/112 |
| 6,128,805 | A | 10/2000 | Rivera | |
| 6,295,991 | B1 * | 10/2001 | Emery | 131/250 |
| D469,677 | S * | 2/2003 | Hung | D8/105 |

* cited by examiner

*Primary Examiner*—Carlos Lopez
(74) *Attorney, Agent, or Firm*—Paul & Paul

(57) ABSTRACT

A multipurpose cigar tool is provided that is able to be carried in the pocket of a user. The tool includes a number of implements moveable between closed and open positions in a recess of a base and outwardly of the bases respectively. The implements include a cigar gripping implement that functions as a cigarstand, a scissors for cutting a cigar, a cigar bandslicer that also includes a bottle opener, and a cigar poker that includes a screwdriver end.

5 Claims, 6 Drawing Sheets

MULTIPURPOSE CIGAR TOOL

CROSS-REFERENCE TO RELATED APPLICATIONS

This application is based on and claims the priority benefit of U.S. provisional application No. 60/639,902, filed Dec. 29, 2004.

FIELD OF INVENTION

This application relates to a multipurpose cigar tool that is able to be carried in the pocket of a user, or elsewhere, where such a tool may be kept in a desirably small location, as a matter of convenience.

BACKGROUND OF THE INVENTION

In the prior art, it is known to employ small tools adapted to be carried in the pocket of a user, such tools including, but not being limited to Swiss Army Knives.

Generally, such tools employ a number of implements carried by a tool body, such implements generally be pivotally openable out of the tool body for use, and pivotally closable into the tool body when not in use, so that they can safely be carried in the pocket of a user, without damaging the user or the user's pocket. Such tools, such as Swiss Army Knives, generally carry among their implements, a pocket knife, a screwdriver, a corkscrew, a drill, etc.

It has been known to provide cigar tools, wherein such tools are generally large, and are adapted to be situated on a desk, smoking stand or the like, and which are not adapted to be carried in the pocket of a user, with the implements thereof capable of being folded away into the tool.

Some cigar tools, such as the collapsible cigar corer of U.S. Pat. No. 6,092,289, are known to exist, and which provide certain implements that may be useable by a cigar smoker.

THE PRESENT INVENTION

The present invention is directed to providing a multipurpose cigar toot that is able to be carried in the pocket of a user, wherein a tool body has a plurality of implements pivotally mounted therein, and moveable between closed positions and open positions, and which in the closed positions are disposed in a recess of the tool body, and specifically where one such implement comprises a cigar gripping implement that functions as a cigarstand when the tool is placed on a supporting surface.

It is an object of this invention to provide a multipurpose cigar tool including a tool body in a plurality of implements that are pivotally mounted on the body and moveable between closed positions and open positions, but which are disposed in a recess in the tool body in the closed position.

A further object of this invention resides in providing a multipurpose cigar tool which includes pivotally connected grippers, and in which the grippers provide a selected gripping force to the cigar via a ratchet mechanism.

It is a further object of this invention to accomplish the above objects, wherein another implement of the tool includes a scissors for a cutting a cigar.

It is yet another object of this invention to accomplish any of the above objects, wherein another implement for the tool includes a bandslicer.

A further object of this invention is to accomplish any of the above objects, wherein tool includes an implement having a bottle opener carried thereon.

Another object of the invention includes providing a multipurpose cigar tool wherein an implement thereof is a cigar poker, with or without a screwdriver end.

Other objects and advantages of the present invention will be readily apparent upon a ready of the following brief descriptions of the drawing figures, the detailed descriptions of the preferred embodiments, and the appended claims.

BRIEF DESCRIPTIONS OF THE DRAWING FIGURES

FIG. 1 is a perspective view of the multipurpose cigar tool in accordance with this invention, and wherein the various implements of the tool are shown in "open" positions, adapted for use.

FIG. 2 is a perspective of the multipurpose cigar tool of FIG. 1, wherein all of the implements of the tool are shown in their "closed" positions, inside a recess means in the tool body, with the exception of the cigar holder, which shows gripping members of the cigar holder in gripping engagement around a cigar, and with the cigar tool being disposed on a flat surface, for facilitating the use of the tool as a cigarstand.

Figure 5:
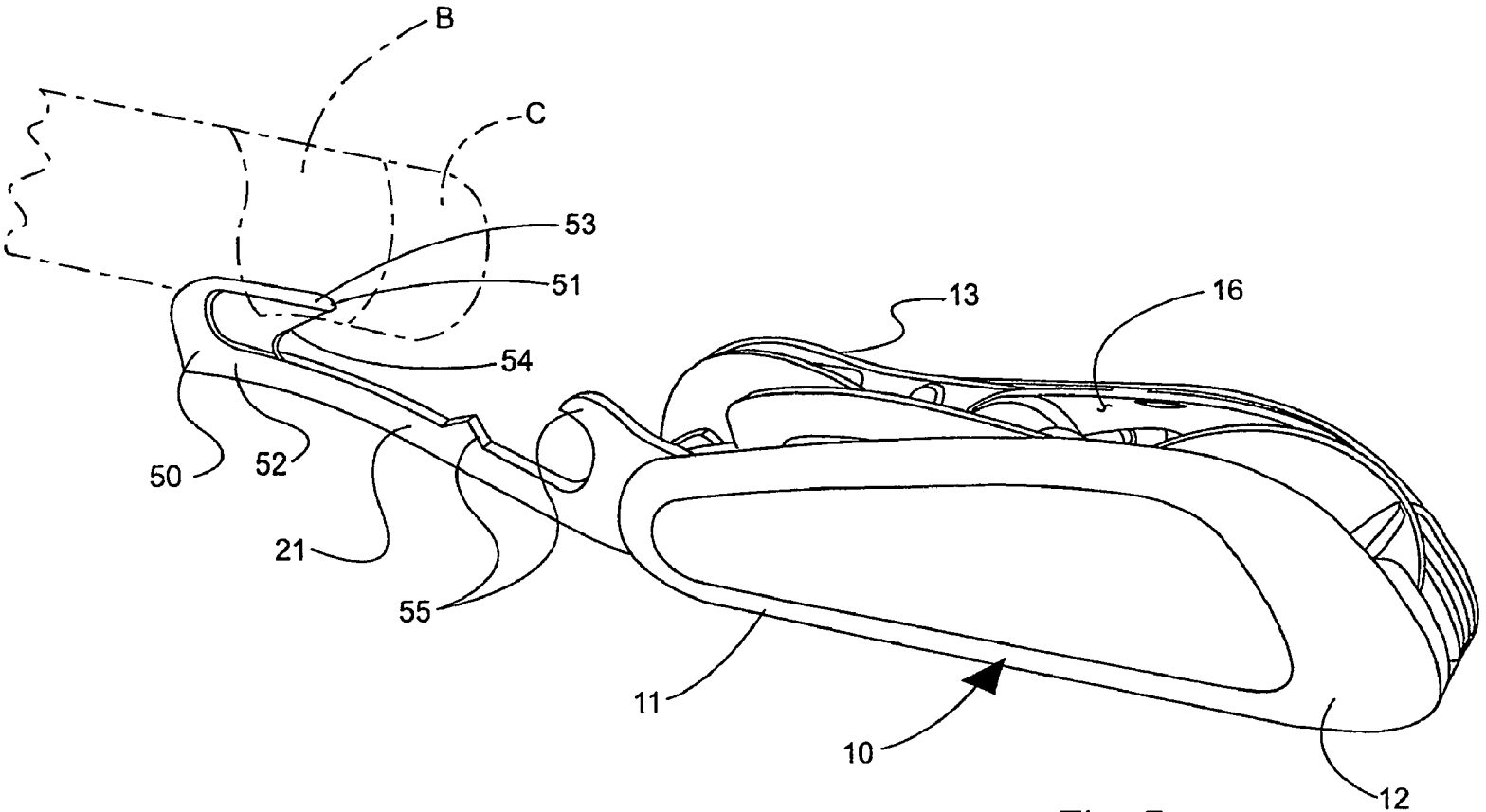

FIG. 5 is a perspective view of the multipurpose cigar tool of this invention, wherein all of the implements thereof are shown in their pivotally "closed" positions in the recess means of the tool body, with the exception of the implement which carries a bandslicer and bottle opener, which is shown in "open" position, with the bandslicer component thereof in slicing engagement between a cigar band and the cigar about which the band is disposed.

Figure 6:
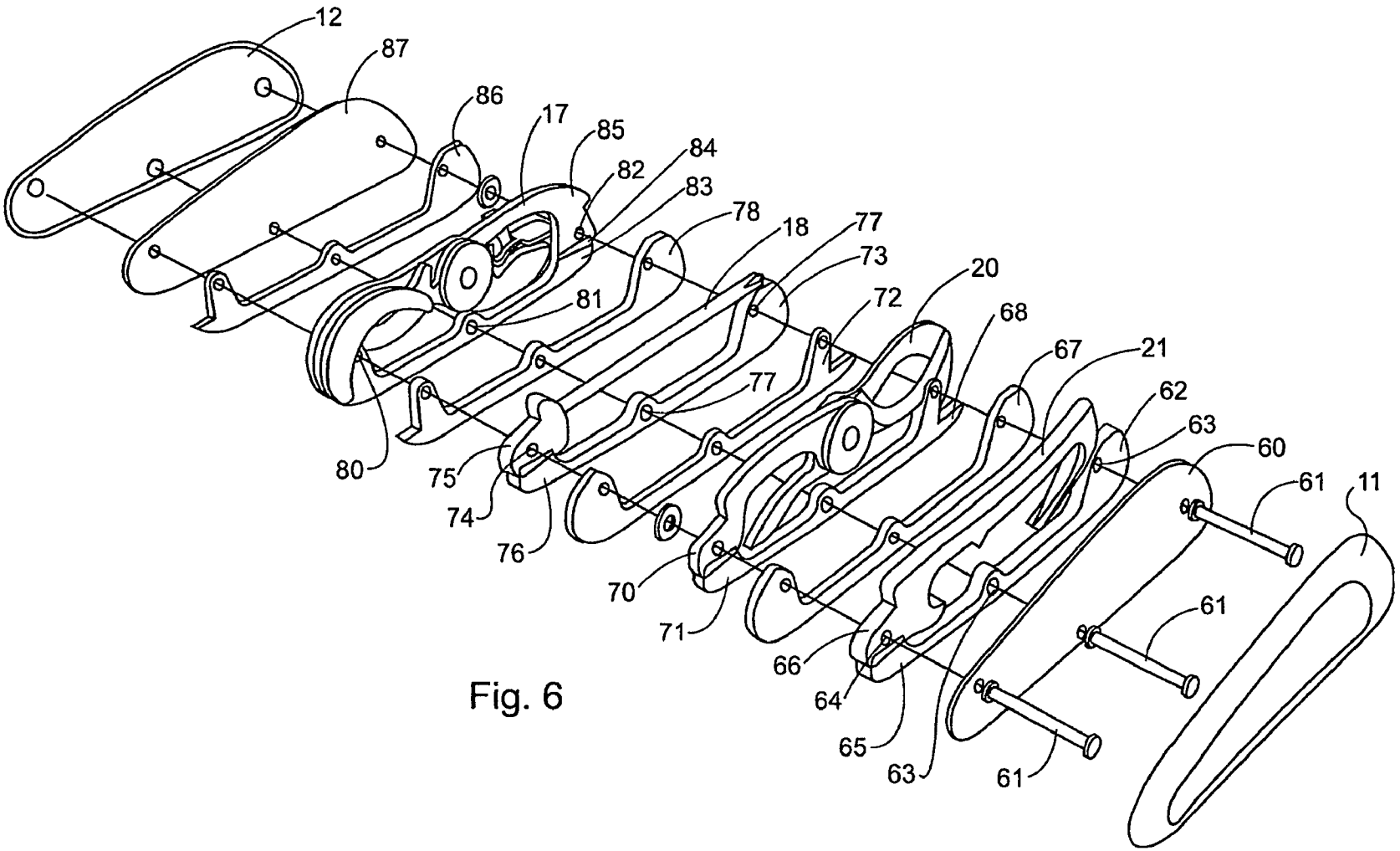

FIG. 6 is an exploded, perspective view of the various components that make up the multipurpose cigar tool of this invention.

DETAILED DESCRIPTIONS OF THE PREFERRED EMBODIMENTS

Figure 1:
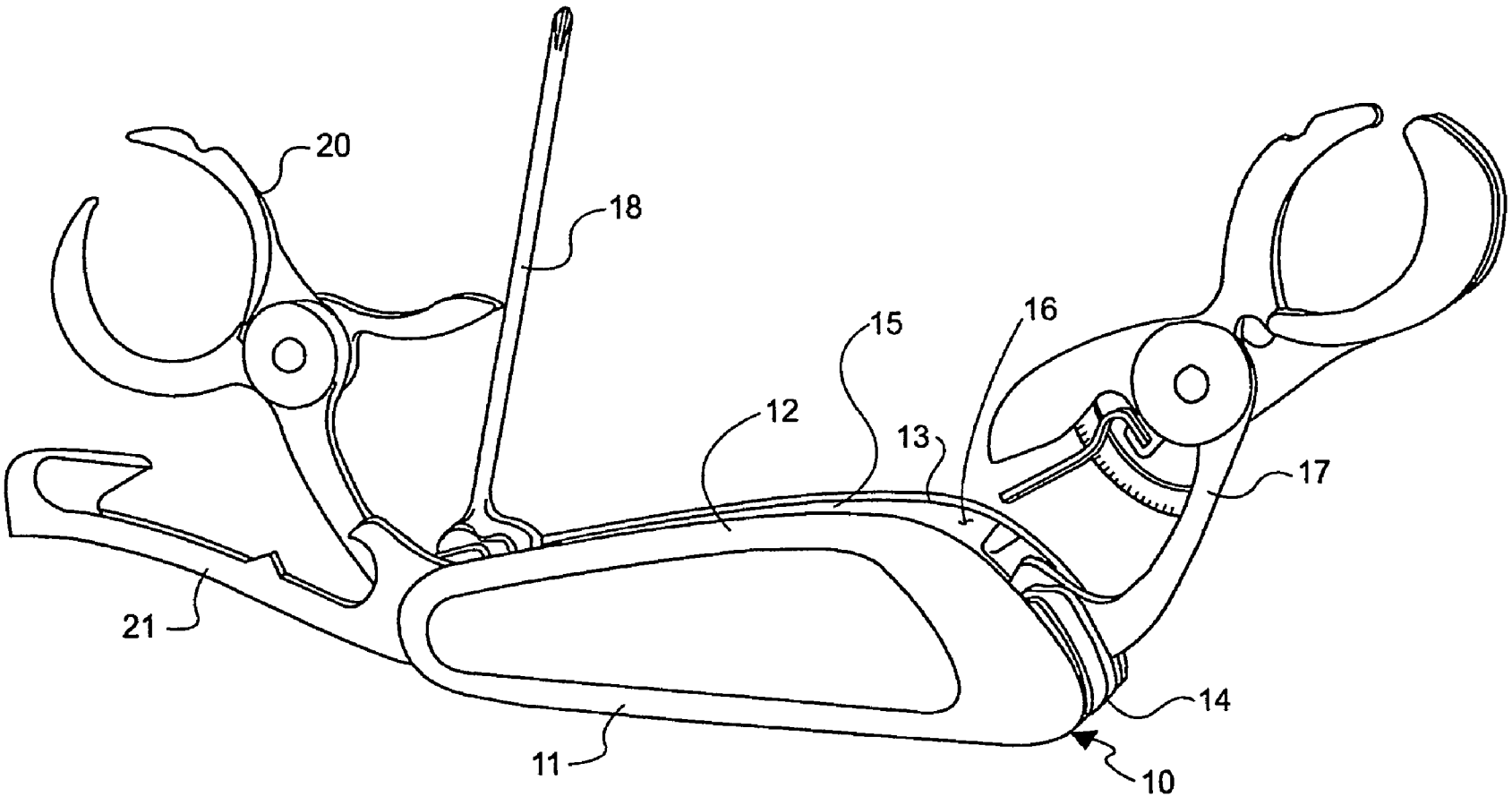

Referring now to the drawings in detail, reference is first made to FIG. 1, wherein the multipurpose cigar tool of this invention is generally designated by the numeral 10.

The cigar tool 10 includes a tool body 11 comprised of opposite lateral sides 12 and 13, a substantially closed bottom 14 and a substantially open top 15, with an implement-receiving recess means 16 between the lateral sides 12 and 13.

A plurality of implements are pivotally mounted on the body 11, moveable between closed positions in which they are disposed in the recess means 16 and open positions in which they are pivotally moveable outwardly of the recess means 16, through the open top 15, with the implements 17, 18, 20 and 21 being shown in the illustration of FIG. 1, in their "open" positions.

Figure 2:
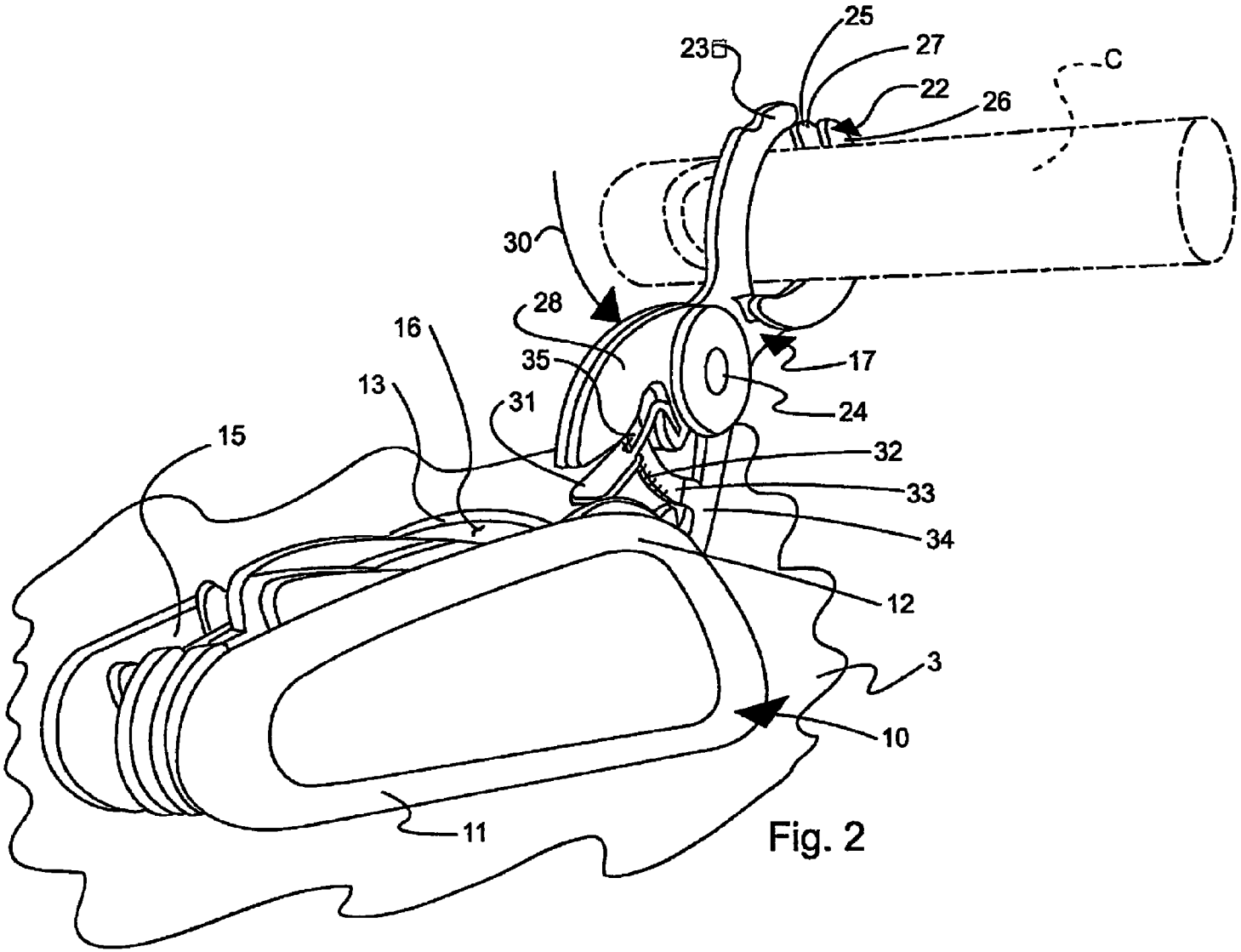

With specific reference to FIG. 2, it will be seen that the tool 10 is again shown, with its body comprised of opposite lateral sides 12 and 13 having received therebetween, all of the implements 18, 20 and 21, within the recess means 16, to be in the "closed" positions thereof, with the exception of the cigar gripping element 17, which is shown in its "open" position.

The tool 10 as shown in FIG. 2 is shown functioning as a cigarstand, in that the tool 10 is illustrated resting on a generally flat surface "S", and carries a cigar "C" in supported relation therein, between a pair of gripping elements 22 and 23, shown in opposition to each other and pivotally connected to each other at 24, with the cigar "C", being shown in phantom between the elements 22 and 23.

Gripping element 22 has two laterally spaced sub-components 25, 26, with an open space 27 therebetween.

Connected to the gripping element 22, on the opposite side of the pivot 24, is an actuation lever 28, which when depressed downwardly in the direction of the arrow 30, causes the opposing gripping elements 22 and 23, to come together under some desired and selected gripping force, to snugly engage the cigar "C" therebetween As the lever 28 is moved downwardly, as described above, a ratchet tang 31 thereof, engages one of a plurality of ratchet teeth 32 carried on an upstanding leg 33 of mount member 34 that is an extension of the gripping element 23, across the pivot point 24, such that the tang 31 progressively engages the teeth 32 within its recess 35, until the cigar "C" is engaged with the desired force, in a snug relationship for supporting the cigar "C".

When it is desired to release the cigar "C", from gripping engagement between gripping elements 22 and 23, the tang 31 is engaged at its lower surface by the user, and lifted upwardly, in an opposite direction to that of the arrow 30, such that the ratcheted gripping engagement is released and the cigar "C", may be removed from the tool 10.

Figure 3:
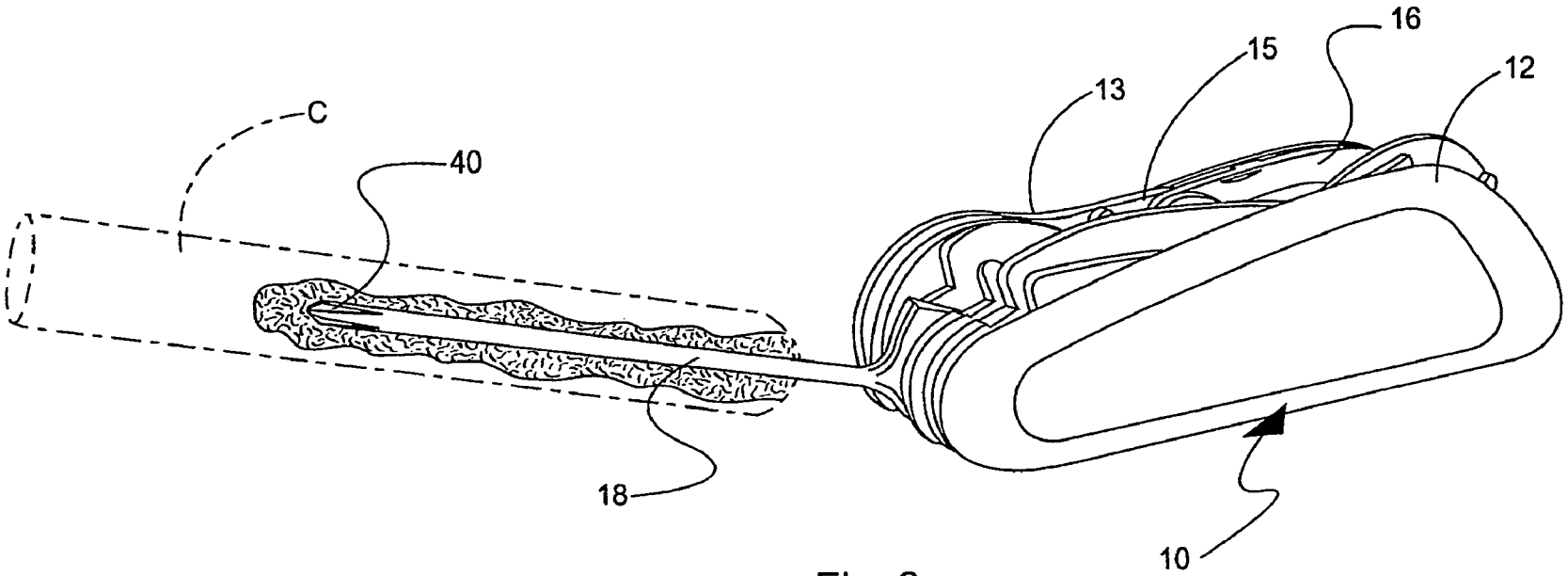
FIG. 3 is a perspective illustration of the multipurpose cigar tool of this invention, wherein all of the implements of the tool are shown in "closed" disposition within recess means of the tool, with the exception of the cigar poker, which is shown in an "open" position, poking a smoke passageway longitudinally through a cigar.

With reference now to FIG. 3, it will be seen that all of the implements of the tool 10 are shown in their "closed" disposition within the recess means 16, with the exception of the poker 18.

The poker 18 is in the form of an elongate thin rod for insertion down through the center of a cigar "C", as is shown in phantom in FIG. 3, for opening a passageway for facilitating the drawing of smoke longitudinally through the cigar.

The poker 18 is pivotally mounted at the left end of the tool 10 as shown in FIG. 3, and carries a Phillips screwdriver end 40 at the outermost end thereof, with the end 40 facilitating entry of the rod 18 through a cigar, as shown, and also being useable as a screwdriver tool, in its own right.

The poker 18 is mounted in the tool 10, in a manner that will be more clearly shown, with reference to FIG. 6, which will be discussed hereinafter.

Figure 4:
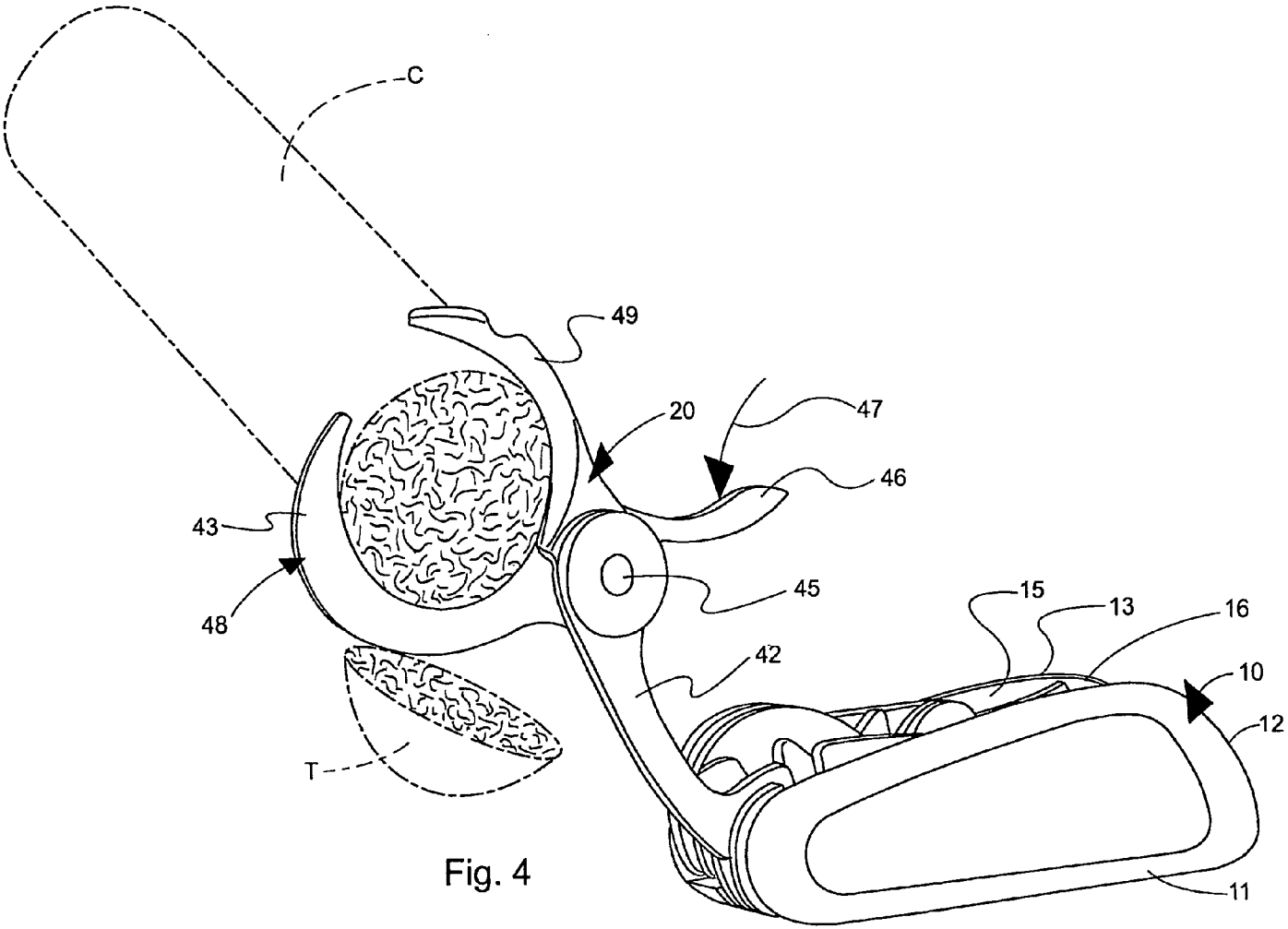
FIG. 4 is a perspective illustration of the multipurpose cigar tool of this invention, wherein all of the implements thereof are shown in their pivotally "closed" positions within the recess means of the tool body, with the exception of the cigar-cutting scissors, which is shown in an "open" position, in cutting engagement with the end of a cigar.

With reference now to FIG. 4, it will be shown that all of the implements of the cigar tool 10 are shown in their "closed" disposition within the recess means of the tool, with the exception of the cigar-cutting scissors implement 20, which is shown in its "open" position, adapted for use in cutting a cigar "C", shown in phantom in FIG. 4, with a tip "T" of the cigar "C" being shown cut off from the remainder of the cigar "C" by means of the scissors 20.

The scissors 20 includes a supporting leg 42, pivotally mounted between opposite lateral sides 12, 13 of the tool 10, at the left end thereof, and as will more clearly be understood with reference to FIG. 6, with the leg 42 having opposed scissors halves 43, 44, pivotally mounted at 45, as shown. The scissors half 44 is an extension of the leg 42, with the scissors half 43 pivotally connected thereto, and having an actuation lever 46 that is an extension of the scissors half 43. A torsion spring (not shown) of a conventional type is located about the pivot 45, providing resistance to the scissors halves 43 and 44 being closed together, such that, when a user of the tool 10 actuates the lever 46, by moving the same downwardly from the position therefor illustrated in FIG. 4, to depress the lever 46, the scissors half 43 will move arcuately in the direction of the arrow 48 shown in FIG. 4, toward the scissors half 44, against the resistance of the torsion spring, such that further downward movement of the lever 46 can cut the tip "T" away from the remainder of the cigar "C".

Referring now to FIG. 5, it will be seen that the tool 10 is shown, with all of its implements in the "closed" position, between lateral sides 11 and 13, in the recess means 16, with the exception of the combination bandslicer/bottle opener implement 21, which is shown in its pivotal "open" position, for slicing a band "B" disposed about a cigar "C", shown in phantom in FIG. 5.

The implement 21 comprises an elongate rod which, at its remote or outer end 50, is substantially "U"-shaped, as shown in FIG. 5, comprising a pair of legs 51 and 52. The leg 51 has a smooth and slightly rounded outer surface 53, adapted to slide along the outer surface of the cigar "C", inside the band "B", and the tool will then be pulled downwardly, or rightwardly as viewed in FIG. 5, such that an inwardly facing blade edge 54 can cut the band "B", from inside, for removal from the cigar "C".

The rod 21 also carries a bottle opener 55 of conventional construction, at the opposite end of the rod 52 from the bandslicer end 50, as shown in FIG. 5.

It will be apparent from the forgoing that the scissors elements 43, 44 will most preferably be very sharp, for readily cutting the cigar "C".

When the tool 10 is used in the form of a cigarstand, as shown in FIG. 2, the weight of the tool base 11 itself functions as a counterbalance to whatever weight the cigar "C" provides when carried therein as shown in FIG. 2, for readily holding the cigar as shown in FIG. 2. It will also be apparent that a user can place the cigar thus held by the cigarstand as shown in FIG. 2 on any flat surface, such as a desk, table, driveway, the fairway at a golf course, etc: Furthermore, in accordance with this invention, while a cigar "C" is being gripped as shown in FIG. 2, it can also be smoked comfortably, allowing the smoker to lift the tool 10 carrying the cigar "C" therein, and smoke the cigar down to its nub, allowing perhaps an additional 10 minutes of smoking that would not be possible if the cigar "C" were held between the fingers of one's hand.

In connection with the bandslicer implement of this invention, as shown in FIG. 5, it will be seen that unique shape of the bandslicer end 50, and especially its outer leg 53, being of somewhat rounded configuration for engaging against the outer surface of the cigar "C", allows one to easily slice a band "B" without doing any damage to the cigar "C" disposed therebeneath.

With reference to the poker implement 18 illustrated in FIG. 3, when cigars are tightly packed, such are sometimes referred to as being "plugged", in that they are hard to draw smoke therethrough, sometimes requiring the smoker to either discard the cigar, or to try to open it up in some manner that does damage to the cigar "C", unlike the poker 18 of the present invention.

With reference now to FIG. 6, it will be seen that just inside, or leftward of the lateral side 11 is a spacer 60, having holes (unnumbered), through which three connectors 61 are disposed. Leftward of the spacer 60, is a spring member 62, which will be mounted on two of the connectors 61 via holes 63, but that, an additional hole 64 of the bandslicer implement 21 will be mounted at the end 65 of the spring member 62, such that, when the implement 21 is moved upwardly from the position shown in FIG. 6, such that hole 64 rotates about the connector about which it is disposed, the end 66 of the implement 21 will cam against the leftmost end 65 of the spring member 62, meeting resistance against opening the implement 21, but also providing a spring-like resistance against accidentally opening the implement 21 when it is desired to be maintained "closed" with the recess means 16.

A spacer member 67 is disposed leftward of the spring member 62, and leftward of the spacer member 67, is another spring member 68, for mounting the scissors implement 20, for pivotal movement relative to its spring member 68, with the leftmost end 70 of the scissors implement 20 likewise being adapted to be cammed against the end 71, in a spring-resistant manner for opening and closing the implement 20, in a manner similar to the opening and closing against a spring-like force as described above with respect to the implement 21.

Leftward of the spring member 68, is disclosed a spacer member 72, having a spring member 73 disposed thereagainst, carrying the poker implement 18 pivotally mounted in pivot hole 74' and with the leftmost end 75 of the poker member being shown in cam-like engagement with a leftmost end 76 of the spring element 73, when connectors 21 mount the spring element 73 through mounting holes 77 of the spring element 73, as shown. Thus, the poker 18 will be mounted for spring-biased pivotal motion between its "open" and "closed" positions, in the same manner as described above with respect to the scissors implement 20 and the bandslicer implement 21.

Next to the spring element 73, is a spacer 78, having holes 80 and 81 for accommodating connectors 61, and with the gripping element 77 being pivotally mounted on a connector 61 extending through its hole 82, with a spring element 83 being adapted to provide resistance via its end 84 in cammed engagement against end 85 of the gripping implement 17, as the gripping implement is moved between its "open" and "closed" positions, pivoting about pivot point 82.

Leftward of the spring element 83 as shown in FIG. 6, there is another spacer 86, which, along with the spacers 78, 72 and 67, comprise portions of the closed bottom 14 of the tool 10. Against the spacer 86 is another spacer 87, against which lateral side 12 of the tool 10 is disposed in the assembled condition of the sundry components illustrated in FIG. 6.

It will be apparent from the forgoing that various modifications may be made in the details of construction, as well as in the use and operation of the multipurpose cigar tool of this invention, as described herein, and as equivalents thereof, all within the spirit and scope of the invention as defined in the appended claims.

What is claimed is:

1. A multipurpose cigar tool adapted to be carried in the pocket of a user, comprising:

(a) a tool body comprising a pair of opposite lateral sides, a substantially closed bottom and a substantially open top and having implement-receiving recess means between said lateral sides;

(b) a plurality of implements pivotally mounted on said body and movable between closed positions in which they are disposed in said recess means and open positions in which they are pivotally movable outwardly of said recess means, through said open top;

(c) wherein one said implement comprises a cigar gripping implement;

(d) said cigar gripping implement including a pair of cigar grippers having opposing, generally arcuate gripper elements adapted to hold a cigar therebetween; whereby (e) said cigar gripping implement and said tool body together function as a cigar stand when the bottom of the tool body is disposed on a surface; and (f) wherein gripping force means are provided, carried by and comprising part of the cigar tool, for closing the grippers around a cigar to a selected gripping force and for holding and supporting the cigar under the selected gripping force.

2. The cigar tool of claim 1, wherein the gripping force means comprise a ratchet mechanism and a quick release lever both carried by and comprising part of the cigar tool, with the quick release lever comprising means for releasing said ratchet means and opening said grippers.

3. The cigar tool of claim 1, wherein another said implement comprises a cigar scissors for cutting a cigar; said scissors including a pair of scissors halves pivotally movable toward and away from each other and spring means operating to resist their movement toward each other.

4. The cigar tool of claim 1, wherein another said implement comprises a poker.

5. The cigar tool of claim 4, wherein said poker is in the form of an elongate thin rod for insertion longitudinally into a cigar for opening passageway for facilitating the drawing of smoke therethrough.

* * * * *

UNITED STATES PATENT AND TRADEMARK OFFICE

CERTIFICATE OF CORRECTION

PATENT NO. : 7,762,266 B2
APPLICATION NO. : 11/721071
DATED : July 27, 2010
INVENTOR(S) : Steven Strasheim It is certified that error appears in the above-identified patent and that said Letters Patent is hereby corrected as shown below:

Column 1 line 41, after "cigar", delete "toot" and insert -- tool --

Column 5 line 19, after "hole", delete "74'" and insert -- 74 --

Signed and Sealed this

Twelfth Day of October, 2010

David J. Kappos

David J. Kappos
*Director of the United States Patent and Trademark Office*